United States Patent [19]

Mochizuki et al.

[11] Patent Number: 4,859,977

[45] Date of Patent: Aug. 22, 1989

[54] INSULATOR DEVICE FOR POWER TRANSFORMER

[75] Inventors: Kazuto Mochizuki, Yokohama; Katsushi Kawahara, Tokyo, both of Japan

[73] Assignee: Akai Electric Company, Limited, Tokyo, Japan

[21] Appl. No.: 262,986

[22] Filed: Oct. 26, 1988

[30] Foreign Application Priority Data

Oct. 27, 1987 [JP] Japan ..... 62-163923[U]

[51] Int. Cl.[4] ..... H01F 15/02

[52] U.S. Cl. ..... 336/65; 174/138 D; 336/100; 411/112

[58] Field of Search ..... 336/65, 100, 92; 174/138 D; 411/112, 512

[56] References Cited

U.S. PATENT DOCUMENTS

| | | | |
|---|---|---|---|
| 2,494,350 | 1/1950 | Mittermaier | 336/65 |
| 4,111,361 | 9/1978 | Sonneville | 174/138 D |
| 4,286,642 | 9/1981 | Keatley | 411/512 X |

*Primary Examiner*—Thomas J. Kozma

*Attorney, Agent, or Firm*—Oblon, Spivak, McClelland, Maier & Neustadt

[57] ABSTRACT

An insulator device to be inserted between a power transformer and a conductive chassis. Insulative washers are monolithically formed with the spacer. One washer is formed for each screw holding the transformer to the chassis. Each washer has a cylindrical protrusion which fits into a hole in the spacer. The screw extends through the washer, protrusion and spacer so as to be insulated from the transformer.

4 Claims, 1 Drawing Sheet

INSULATOR DEVICE FOR POWER TRANSFORMER

BACKGROUND OF THE INVENTION

1. Field of the Invention

The present invention generally relates to an insulator device for a power transformer and more particularly to an insulator device which enables a power transformer to be fixedly mounted on a chassis and electrically insulated therefrom.

2. Description of the Background

In a conventional apparatus using a conductive chassis, the core of a power transformer is in electrical contact with the chassis, since, in general, the power transformer is fixedly mounted on the chassis by means of metal screws and a metal band holding the transformer. This structure may form an imaginary circuit between the core and ground with respect to high frequency noise currents which may flow through a primary coil of the transformer. In such a circuit, the noise currents flow through a series of stray capacitances between the coil and the core as well as the chassis and ground. To this end, the appearance of such a imaginary circuit is likely to lead to fluctuations of the ground potential of electronic circuits formed on the printed substrate, thereby causing the undesirable operation of the apparatus, or the deterioration of tone quality in the case of hi-fi equipment.

SUMMARY OF THE INVENTION

Accordingly, it is a first object of the present invention to provide an insulator device for a power transformer which effectively prevents an electronic apparatus from undesirable operation due to high frequency noise currents which flow from a power source.

It is another object of the present invention to provide an insulator device for a power transformer which insulates the power transformer from the chassis in a simple and reliable manner.

It is still another object of the present invention to provide an insulator device for a power transformer which can accommodate various sizes of the transformer to be mounted.

In order to accomplish the above-described objects, the present invention provides an insulator device inserted between a power transformer and a chassis of an electronic apparatus, which device carries at least one monolithically formed insulation washer having a cylindrical portion for insulating the metal band from the fixing screws.

DESCRIPTION OF THE PREFERRED EMBODIMENT

Figure 1:
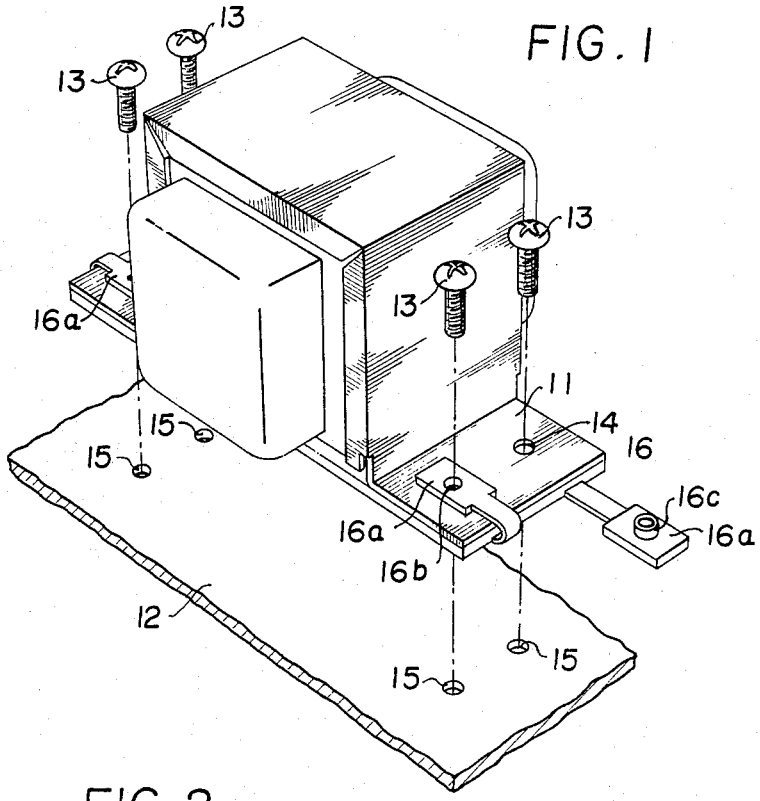
FIG. 1 is a perspective view of a first embodiment according to the present invention.
Figure 2:
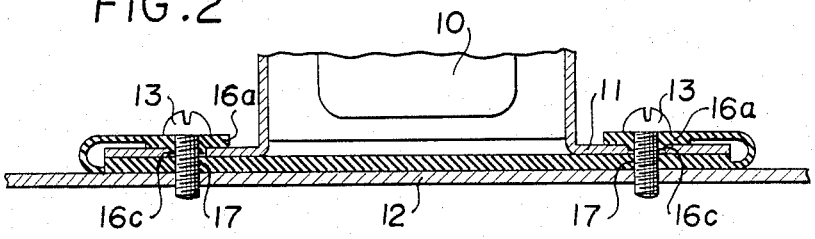
FIG. 2 is a fragmentary sectional view of the first embodiment according to the present invention.

FIGS. 1 and 2 show the first embodiment of the present invention. A power transformer 10 held by a metal band 11 is mounted on a chassis 12 of an electronic apparatus by means of four screws 13, with each screw passing through a corresponding hole 14 in the horizontal portion of the metal band 11 and being engaged with a corresponding screw hole 15 provided on the chassis 12. In the above construction, electrically conductive materials are used for the transformer 10, the band 11, the chassis 12, and the screws 13. Between the bottom of the transformer 10 and the chassis 12, there is provided an insulation spacer 16 covering the bottom of the transformer 10 s well as one side of each horizontal portion of the band 11 which faces the chassis 12. This spacer 16 is made of electrically non-conductive and mechanically elastic material, for example, rubber, or synthetic resins.

The spacer 16 carries two insulation washer portions **16*a* on each of the two shorter sides thereof, each washer portion 16*a* having a cylindrical portion 16*c* which extends to one side and a hole which extends through the washer and the cylindrical portion. These portions 16*a*, 16*b*, 16*c* and the spacer 16 are monolithically formed, and the portion 16*c* is adapted to be inserted into the hole 14 of the band 11 when the washer portion 16*a* is folded back to lay on the horizontal portion of the metal band 11**.

On the spacer 16, four through holes 17 are provided which align with the holes 14 and the screw holes 15 so that the transformer 1 may be fixedly mounted on the chassis 12 by the screws 13.

In this embodiment, the transformer 10 may be mounted on the chassis 12 in accordance with the following procedure:

The spacer 16 is interposed between the transformer 10 with the band 11 and the chassis 12, and then, each washer portion **16*a* is folded back to lay on the corresponding hole 14 of the metal band 11, with each cylindrical portion 16*c* being inserted into the corresponding hole 14. In this state, screws 13 are put into the cylindrical portions 16*c* through the holes 16*b* and reach the screw holes 15 after passing through the holes 14 and the through holes 17. Finally, the transformer 10 is fixedly mounted on the chassis 12 by turning the screws 13**.

According to the above embodiment, the power transformer 10 is completely an effectively insulated from the chassis 12. In other words, insulation can be obtained between not only the transformer 10 and chassis 12 through the spacer 16 but also between the screws 13 and the metal band 11 through the washer portion **16*a* and the cylindrical portion 16*c*. Furthermore, this provision realizes complete insulation between the transformer 10 and the chassis 12 without using separate components for insulating screws, since the spacer 16 is monolithically formed and carries portions for the insulation of screws 13**.

Figure 3:
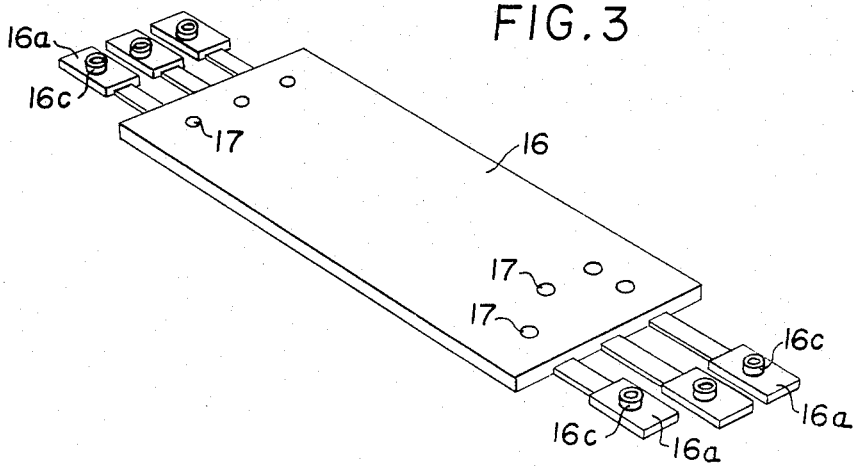
FIG. 3 is a perspective view of an insulator device according to a second embodiment of the present invention.

FIG. 3 illustrates the second embodiment of the present invention, which can accommodate a plurality of sizes of transformers. In FIG. 3, three pairs of washer portions **16*a* and holes 17 protrude from each of the two shorter sides of the spacer 16, one of the washer portions 16*a* having a shorter length than the others and its corresponding hole 17 being provided nearer to the washer portion. Another washer portion 16*c* has two corresponding holes 17, so that the washer portion 16*c* can be folded to lay back on either one of these holes 17** depending on the position of the hole in the metal band.

Obviously, numerous modifications and variations of the present invention are possible in light of the above teachings. It is therefore to be understood that within the scope of the appended claims, the invention may be practiced otherwise than as specifically described herein.

WHAT IS CLAIMED AS NEW AND DESIRED TO BE SECURED BY LETTERS PATENT OF THE UNITED STATES IS:

1. An insulator device and a power transformer, said transformer being mounted on a conductive chassis by at least one screw, comprising:

a spacer between said transformer and said chassis, and having at least one hole receiving said at least one screw to mount said transformer to said conductive chassis;

at least one insulation washer being monolithically formed with said, spacer and being folded to lie above said hole; and a cylindrical portion monolithically formed with said insulation washer and being inserted into said at least one hole to surround said screw;

wherein said transformer is electrically insulated from said chassis.

2. An insulator device as claimed in claim 1, wherein a plurality of insulation washers and corresponding holes are formed with said spacer.

3. An insulator device as claimed in claim 2, wherein said plurality of insulation washers have different lengths.

4. An insulator device as claimed in claim 1, wherein a plurality of holes are provided with respect to one insulation washer.

* * * * *

UNITED STATES PATENT AND TRADEMARK OFFICE

CERTIFICATE OF CORRECTION

PATENT NO. : 4,859,977

DATED : AUGUST 22, 1989

INVENTOR(S) : KAZUTO MOCHIZUKI ET AL

It is certified that error appears in the above-identified patent and that said Letters Patent is hereby corrected as shown below:

In column 1, line 24, change "a" to --an--.

In column 2, line 8, change "s" to --as--;

line 43, change "an" to --and--.

In column 3, line 14, delete ",".

Signed and Sealed this

Thirty-first Day of July, 1990

*Attest:*

HARRY F. MANBECK, JR.

*Attesting Officer*

*Commissioner of Patents and Trademarks*